US005933984A

United States Patent [19]

Carlson et al.

[11] Patent Number: 5,933,984

[45] Date of Patent: Aug. 10, 1999

[54] INSOLE CONSTRUCTION FOR SHOES

[75] Inventors: J. Martin Carlson, Edina; Stacey R. Stoll, Minneapolis, both of Minn.

[73] Assignee: Tamarack Habilitation Technologies, Inc., St. Paul, Minn.

[21] Appl. No.: 08/979,889

[22] Filed: Nov. 26, 1997

[51] Int. Cl.[6] ..... A43B 13/38; A43B 7/14; A43B 19/00; A61F 5/14

[52] U.S. Cl. ..... 36/43; 36/180; 36/166; 36/69; 36/30 R; 36/127

[58] Field of Search ..... 36/43, 44, 173, 36/180, 174, 80, 140, 166, 176, 178, 181, 68, 69, 127, 30 R, 71, 93

[56] References Cited

U.S. PATENT DOCUMENTS

| | | | |
|---|---|---|---|
| Re. 32,698 | 6/1988 | Brown | 36/44 |
| 1,607,896 | 11/1926 | Kelly . | |
| 1,780,574 | 11/1930 | Williams . | |
| 2,018,710 | 10/1935 | Elkin | 36/43 |
| 2,274,205 | 2/1942 | Mann | 36/43 |
| 2,335,187 | 11/1943 | Keil | 36/68 |
| 2,909,854 | 10/1959 | Edelstein | 36/43 |
| 2,917,844 | 12/1959 | Scholl | 36/71 |
| 3,071,877 | 1/1963 | Stickles | 36/44 |
| 3,594,929 | 7/1971 | Stohr | 36/44 |
| 4,149,274 | 4/1979 | Garrou et al. | 2/239 |
| 4,388,734 | 6/1983 | Schwartz | 36/44 |
| 4,510,700 | 4/1985 | Brown | 36/44 |
| 4,635,385 | 1/1987 | Ogden | 36/43 |
| 4,869,001 | 9/1989 | Brown | 36/115 |
| 4,888,888 | 12/1989 | Ashton | 36/43 |
| 4,893,418 | 1/1990 | Ogden | 36/44 |
| 4,925,724 | 5/1990 | Ogden | 36/44 |
| 5,146,698 | 9/1992 | Tilles et al. | 36/44 |
| 5,154,682 | 10/1992 | Kellerman | 36/44 |
| 5,327,664 | 7/1994 | Rothbart | 36/174 |
| 5,388,349 | 2/1995 | Ogden | 36/43 |
| 5,463,824 | 11/1995 | Barna | 36/44 |
| 5,586,398 | 12/1996 | Carlson | 36/114 |
| 5,713,143 | 2/1998 | Kendall | 36/166 |
| 5,727,336 | 3/1998 | Ogden | 36/43 |
| 5,746,011 | 5/1998 | Hedstrom | 36/44 |

FOREIGN PATENT DOCUMENTS

| | | | |
|---|---|---|---|
| 3439675 | 4/1986 | Germany | 36/43 |

*Primary Examiner*—Paul T. Sewell
*Assistant Examiner*—Anthony Stashick
*Attorney, Agent, or Firm*—Westman, Champlin & Kelly, P.A.

[57] ABSTRACT

An insole construction for an athletic shoe has a shell portion that is positioned under the heel and midfoot of the foot, and is covered with an insole and having low friction material on the upper sides in selected regions. The low friction material may be a thin layer of polytetrafluoroethylene material, the low friction material extends across the heel region, and/or across the metatarsal area, and these areas may be joined by a lateral side strip. The shell is cupped to form a wall along the lateral side of the foot and about three quarters of the way behind the heel or calcaneus region of the foot. This cup wall is joined to a base wall with a generously radiused rounded portion that mirrors the concave/convex contour anatomy of the foot in this region for comfort and for distributing impact forces received during running, across a substantially increased contact area of the foot.

17 Claims, 6 Drawing Sheets

22
32
24C
24D
34
10
12
10
48
30
13
50
26
57
22
10
24E
24B
46
24
45
24A
36
5
14
5
44
18
6
40A
6

INSOLE CONSTRUCTION FOR SHOES

BACKGROUND OF THE INVENTION

The present invention relates to an insole construction that includes a rigid molded shell that is positioned under the heel of a user and extends forwardly to a region adjacent, but rearwardly of the metatarsal heads of the foot. In the preferred form the insole comprises a full foot foam layer above the shell with a covering that includes low friction surface material in selected areas where calluses and blisters are likely to be formed.

In the prior art, various constructions for insoles have been advanced to reduce trauma to a foot and to control shear and stress between the foot and the surface of the insole.

U.S. Pat. No. 4,510,700 shows an adjustable shoe insert that includes a relatively rigid shell that is under the foot and in contact with the footbed of a shoe, and is covered with a foam layer. The shell is positioned at the heel of the foot and has a flange that extends around the heel. Providing force distribution and force dissipation throughout the bone structure of the foot is an objective. However, the configuration does not provide sufficient rigidity to adequately spread shock forces that occur in the feet of runners at the moment of initial contact (heel strike).

U.S. Pat. No. 5,586,398 shows an article of footwear that is for efficient running, and it teaches that controlling friction in a running shoe helps to reduce soft tissue trauma upon foot impact.

These structures are typically shown to be useful for their purposes, but the need exists for a light, comfortable, force distributing insole that adequately manages both shock and friction forces seen by the foot to avoid bruising, blisters, thick calluses and the like.

SUMMARY OF THE INVENTION

The present invention relates to an insole for an athletic shoe, particularly for a running shoe, which includes a base shell or insert of relatively rigid material that has a lip or wall curving up-along the postero-lateral side of the heel and extending forward along the lateral side of the midfoot to an anterior termination line preferably extending across the foot just behind the metatarsal heads. The shell underlies the entire plantar surface of the foot posterior of that termination line. The shell can extend forwardly to under the metatarsal heads and the toes if it is provided with hinging sections to permit the foot to flex as the heel rises and a stride is completed. The shell or insert is relatively flat in regions other than under the area where the plantar ligament attaches to the calcaneus and along the lateral side where it is formed to fit the foot and has a raised lip or wall. The raised lip or wall extends along the lateral side and curves to the rear of the calcaneus bone of the heel. The shell provides a substantially rigid heel and midfoot cradle made of a suitable plastic, such as polypropylene, and of suitable thickness so that rigidity is adequate to distribute impact forces when the postero-lateral or lateral side of the heel strikes the ground during initial contact of a stride.

The shape of the shell, especially in the areas where the postero-lateral lip is formed is very important to the proper spreading of impact shock forces. The shape is contoured relatively inward (toward the foot interior) in areas of deeper soft tissue and bulges outward where the bone lies more close to the surface. This shape reflection of the underlying superficial skeletal elements is of additional importance to achieve a more uniform spreading of impact shock forces. Spreading forces in this manner minimizes force concentrations and tissue trauma at the "bonier" (for instance, the tuberosity of the calcaneus and the base of the fifth metatarsal) areas of the foot under impact loads. The anatomically formed postero-lateral lip is important for sufficient "cradling" of downward presented surfaces at the moment of initial contact (in most cases feet are moderately supinated/inverted as they make initial contact). The rigidity of the shell ensures that the shell will not readily deform at the focused area of initial external contact. Such localized deformation is typical for conventional running shoes. Deforming material absorbs some energy but passes the remaining shock forces straight through to a corresponding small area/volume of the foot. The rigidity of the shell of the present invention, working together with the proper contouring insures that the shock forces of initial contact will be more widely and uniformly spread as more force is absorbed by soft tissue areas and less force is seen at the "bonier" areas. This means that maximum levels of tissue stress will be lower and much less likely to exceed pain and trauma thresholds.

The shell has an overlayer of a foam material formed as a conventional insole, extending along the sole of the entire foot. The foam is preferably covered in certain areas with a felt or other relatively high friction, soft material and in friction control areas it is covered with a thin, low friction sheet or a very thin coating of material, such as polytetrafluoroethylene (PTFE) that is available commercially in thin layers.

This shock load spreading shell can function in addition to or as an alternative to the usual thick, soft heel cushion design approach used in most athletic shoes to absorb initial contact shock energy.

The low friction material extends underneath the calcaneus region and forwardly along the lateral side of the foot, leaving the area underneath the arch on the medial side of the foot ahead of the heel with exposed higher friction material such as felt. The low friction material then spans the insole underneath the area of the metatarsal heads (the "ball" of the foot). The low friction material or surface region terminates short of the toe end of the insole such that the region of the insole under the toes is left with the higher friction material exposed.

The low friction material is useful to minimize the transmission of shearing forces to the skin and subcutaneous tissue of the foot. During running and other athletic activities and maneuvers, horizontal forces (medial, lateral, fore and aft) are transmitted between the body and the running (or playing) surface. Exactly how those forces are transmitted between the foot and the running surface depend upon many shoe and sock design and material factors. Those forces are transmitted by a combination of forces (some exerted normal to the skin surface and some, by means of friction, tangential to the skin surface) from various parts of the shoe to various parts of the skin surface encompassed within the shoe.

It is known from experience that the heel and "ball" (area under the metatarsal heads and metatarsal phalangeal joints) of the foot are particularly susceptible to callousing and blistering problems. Callousing and blistering are caused by high levels of shear stress repeatedly exerted on skin and subcutaneous tissue. Those transmissions of shear stress to the skin are minimized when the friction coefficient is minimized. The most practical approach is therefore to manage the friction coefficient to limit shearing force transmission to the skin in areas shown to be susceptible to receiving excessive shear stress. That is the reason for covering the areas under the heel, lateral midfoot (to protect the tissue under the base of the fifth metatarsal), and "ball" of the foot with material having an exceptionally low coefficient of friction. If an individual experiences shear-generated problems on other areas of the foot, those areas can be lined with the same material to minimize friction coefficients within the shoe.

The shell is combined with the friction management insole surface using the higher friction material in the instep area and under the ends of the toes, while having very slippery or low friction surfaces under the calcaneus bone region and the metatarsal area of the foot (the ball of the foot). The tendency to blister because of shear stress, or the formation of calluses because of shear stress is thus greatly reduced.

The higher friction areas are allowed in the selected locations to keep the foot stabilized and provide for reactions when push off is made with the toes during each stride.

In some cases it is desirable to minimize friction only under the metatarsal heads and maintain a higher friction under the heel, or vise versa. Such adjustments to the areas of friction reduction are envisioned as part of this invention.

DETAILED DESCRIPTION OF THE PREFERRED EMBODIMENTS

Figure 1:
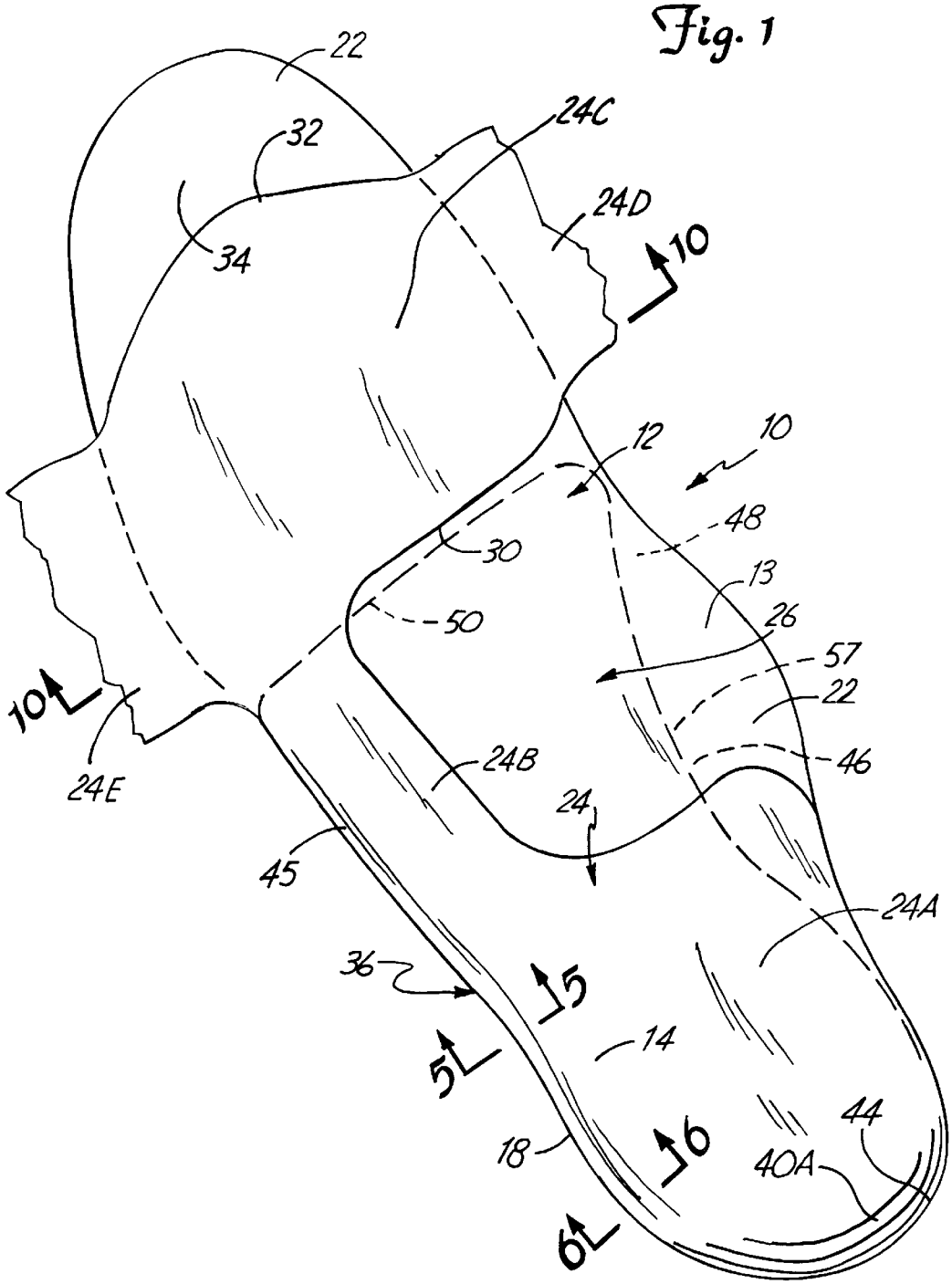
FIG. 1 is a top plan schematic view of an insole including a support shell made according to the present invention.

The insole of the present invention illustrated generally at 10 is shown in connection with a left foot insole only. It is understood that a right foot insole would be constructed in a mirror image of the insole shown. The insole 10 includes an insole pad 12 that, as shown, has a slightly raised arch area 13, and a rounded lateral side having a curved cup like wall 14 that forms a radiused corner to form an upright section. The insole is made to fit within and conform to a relatively rigid shell 18. The insole can have a flat upper surface, if desired, to eliminate the raised arch area and the cup like wall 14. The shell 18 is one piece and is shaped by trim lined edges and molded contours in the heel and midfoot regions.

The shell 18 is positioned below the insole pad 12, and is configured as will be further explained. The insole pad 12 is in the preferred form, made in layers, including a base foam layer 20, that has a covering layer of soft, relatively high friction material such as cotton terry cloth, or other fabrics shown at 22, and in this invention, the upper surface of covering layer 22 of the insole is covered in selected areas with a thin layer of a low coefficient of friction material 24, such as polytetrafluoroethylene (PTFE) (called "low friction" material).

The low friction surface layer is shown at 24 schematically, and, in order to help accomplish the purposes of the invention, the layer 24 is provided with a full width heel section 24A that provides a slippery surface for the sock or foot of the wearer engaging this area. The heel section 24A joins a relatively narrow web portion 24B that extends longitudinally along the lateral side of the insole in the midfoot area. The surface of the higher friction material layer is left exposed under the arch on the medial side as shown at 26. The low friction layer 24 then is expanded to the full medial-lateral width of the insole in the metatarsal head region 24C, which is underneath the "ball" of the foot. The size and shape of the layer 24 can be varied, and portions, such as the web portion 24B, can be eliminated, or if desired, made wider.

The edge 30 defining the rear of region 24C extends laterally across the insole ahead of the arch, but also to the rear of the metatarsal heads of a foot on the insole. The metatarsal head region 24C of the low friction layer 24 terminates along a forward edge 32 that is short of the distal end of the insole form and is positioned to be under a region known as the sulcus of the foot, located behind the contact region of the toes of a wearer. This leaves the higher coefficient of friction liner exposed in the area 34 where the toes contact. The layer 22 of felt or other material is a thin, soft material that does provide for some gripping because of the higher coefficient of friction of felt forming the layer 22. The felt is bonded to the foam layer, so that it does not slip relative to the foam layer 20. The foam layer 20 provides a cushioning effect for absorbing some shock loads, and also providing some conformability for the underside of the foot and the transition where the shell ends and meets the toe box region of the shoe (i.e. it fills small spaces).

The insole foam layer terminates along lines conforming to the outline of a shoe footbed. In the metatarsal region, the side edges of the foam are indicated by dotted lines. The low friction material may also terminate along those dotted lines, or as shown, attached wings 24D and 24E of low friction material are provided, when desired to provide a low friction interface between the sides or top of the foot and the inner surface of the shoe in the toe box.

Figure 10:
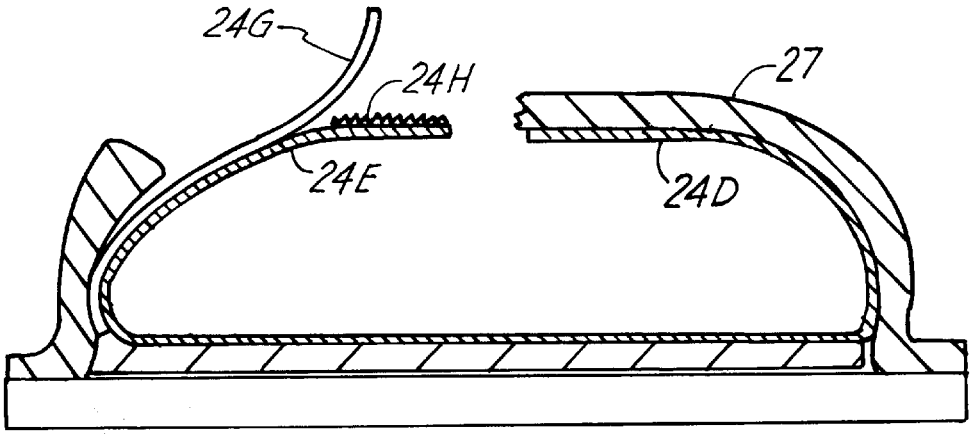
FIG. 10 is a schematic sectional view of an insole of FIG. 1 shown in a shoe and taken along line 10—10 in FIG. 1.

The wings 24D and 24E can have an adhesive layer, at least on the underside in FIG. 1 covered by a release paper 24G shown in FIG. 10. The wings can be wrapped over the top of a foot, the insole and foot then inserted into the shoe and with an accessible tab, the release paper pulled to expose the adhesive layer 24H. The wings will then be pushed with the foot up against the inside surface of a shoe upper 27 so it is held in place. The low friction material reduces the likelihood of abrasion on the tops of the toes and the top of the foot ahead of the instep. The low friction surface of the wings wrapped over the top reduces the likelihood of a foot or toe deformity being subjected to excessive shear stress.

The length of the wings can be selected as desired. If desired, only the sides of the toe box may be covered, or as shown in FIG. 10, substantially the entire top of the toe box may be covered.

The release paper can be pulled out by a long tab folded back to the opening of the shoe, or a similar process can be followed to apply the insole and liner by hand, before a foot is put into the shoe.

Figure 2:
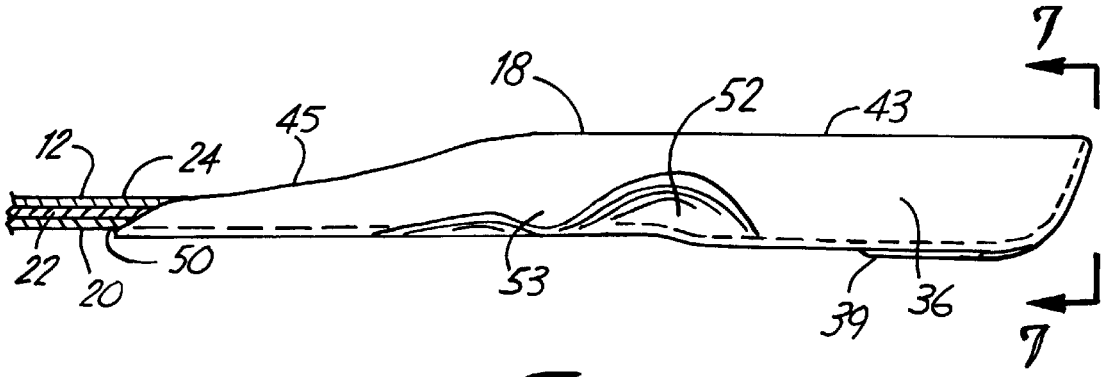
FIG. 2 is a lateral side view of the insole of FIG. 1.
Figure 3:
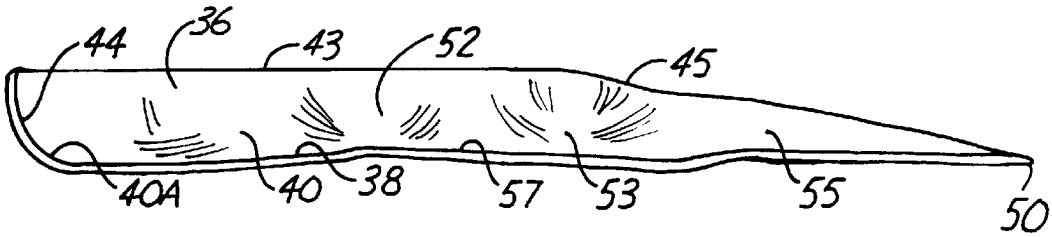
FIG. 3 is a side view of an insole support shell viewed from the medial side.
Figure 4:
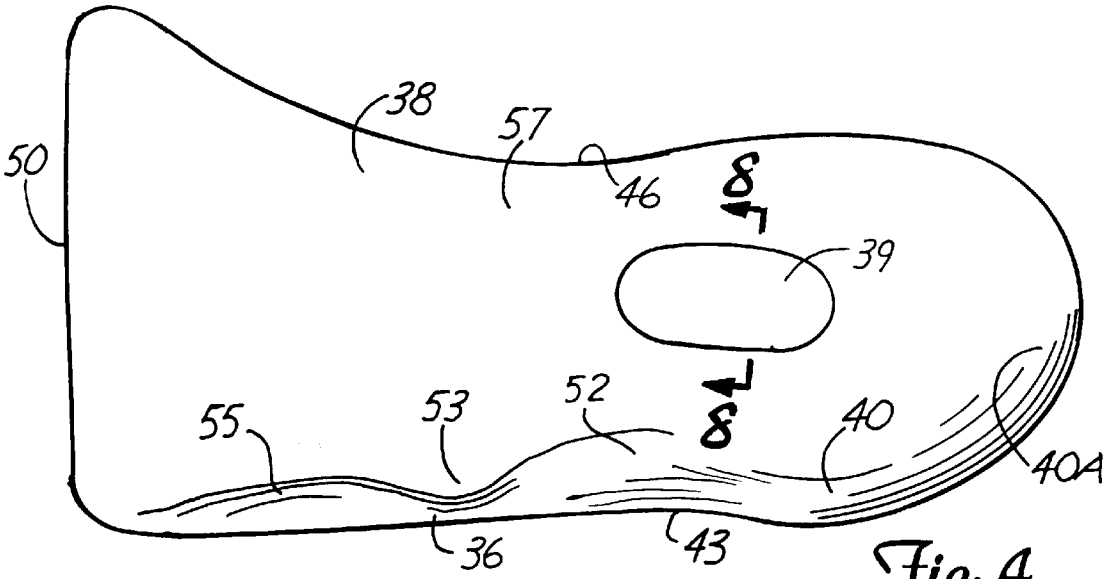
FIG. 4 is a top plan view of the shell of FIG. 2.

The shell 18 as shown in FIGS. 2, 3 and 4 is one unitary piece of relatively rigid plastic, molded into the desired shape, to include a continuous three-dimensional geometric surface that consists of a relatively flat base or plantar wall 38 and an upstanding postero-lateral side cup wall 36 that is joined to the plantar wall 38 in a generous radius wall portion 40 that conforms generally to the rounding of the postero-lateral surface of the foot along that region. The portion 15 of the foam layer 20 conforms to the radiused wall portion 40. The shell distributes shock loads over the plantar and lateral side of the foot.

Figure 8:
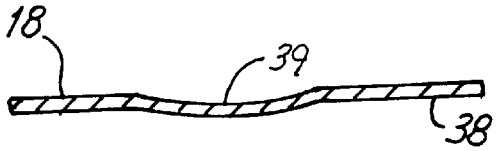
FIG. 8 is a fragmentary sectional view taken on line 8—8 in FIG. 4.

The upper surface of the plantar wall 38 is relatively flat, except relief recesses may be added for accommodating plantar ligaments. One such relief recess is shown at 39 in FIGS. 4 and 8. This is where the plantar ligament attaches to the bottom of the calcaneus. The medial trim line or edge of the shell is made to match the interior plantar surface of the shoe last to allow the shell to lay flat by trimming away along the medial side under the longitudinal arch. This will also help to hold the shell from sliding in a medial or lateral direction by using the maximum allowable width in the heel and along the distal trim line or edge 50. The distal trim edge 50 occurs parallel and slightly proximal (within about ¼ inch) to a tangent line drawn between the proximal edges of the first and fifth metatarsal heads (see FIG. 9).

Figure 7:
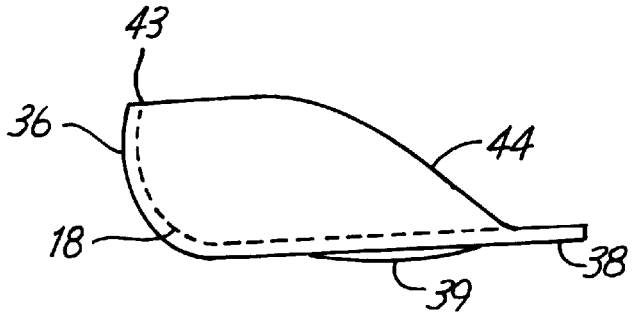
FIG. 7 is a rear view of the shell taken generally along line 7—7 in FIG. 2.

The wall 36 begins to rise up from the plantar wall 38 at a location proximal to the heel, as shown at 44 in FIG. 7, and reaches its maximum height (approximately one inch) at a location lateral of its point of origin. The top edge 43 of wall 36 maintains the same height as it wraps around the heel and around the lateral side of the foot (see FIGS. 2 and 3). Wall 36 begins a beveled decent along a line 45 at a point between the base of the fifth metatarsal and the head of the fifth metatarsal. The wall 36 terminates as it transitions to the lateral side of the plantar wall distal trim line 50. The trim line 50 extends laterally across the insole.

Figure 5:
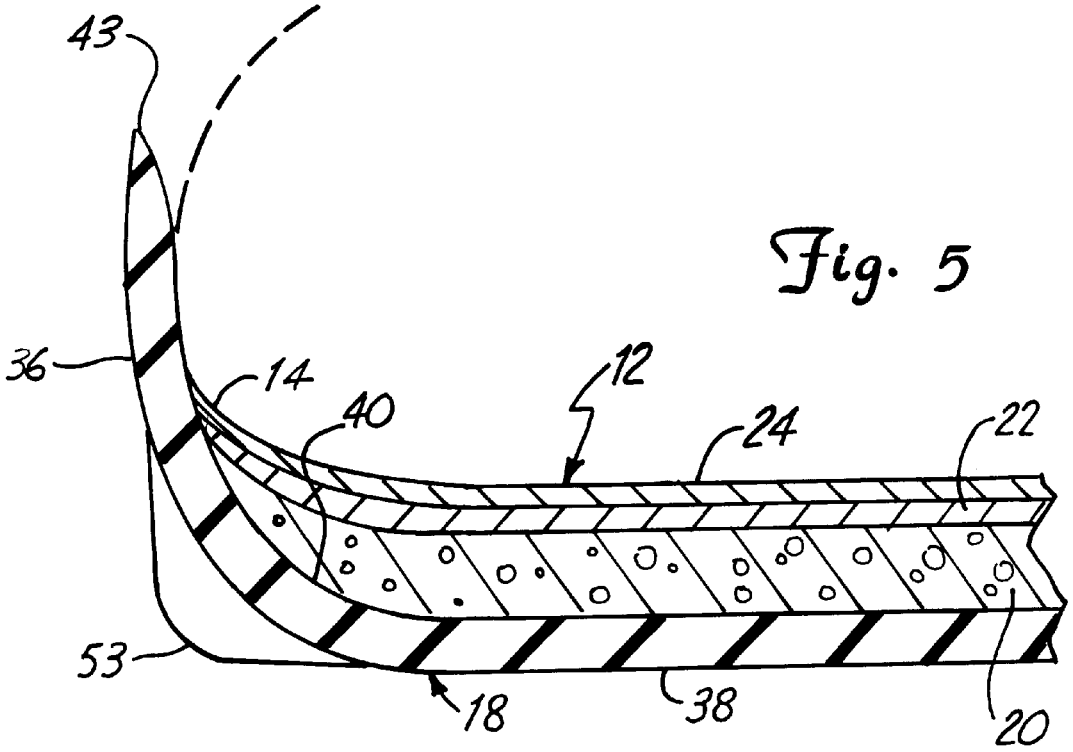
FIG. 5 is an enlarged sectional view taken on line 5—5 in FIG. 1.
Figure 6:
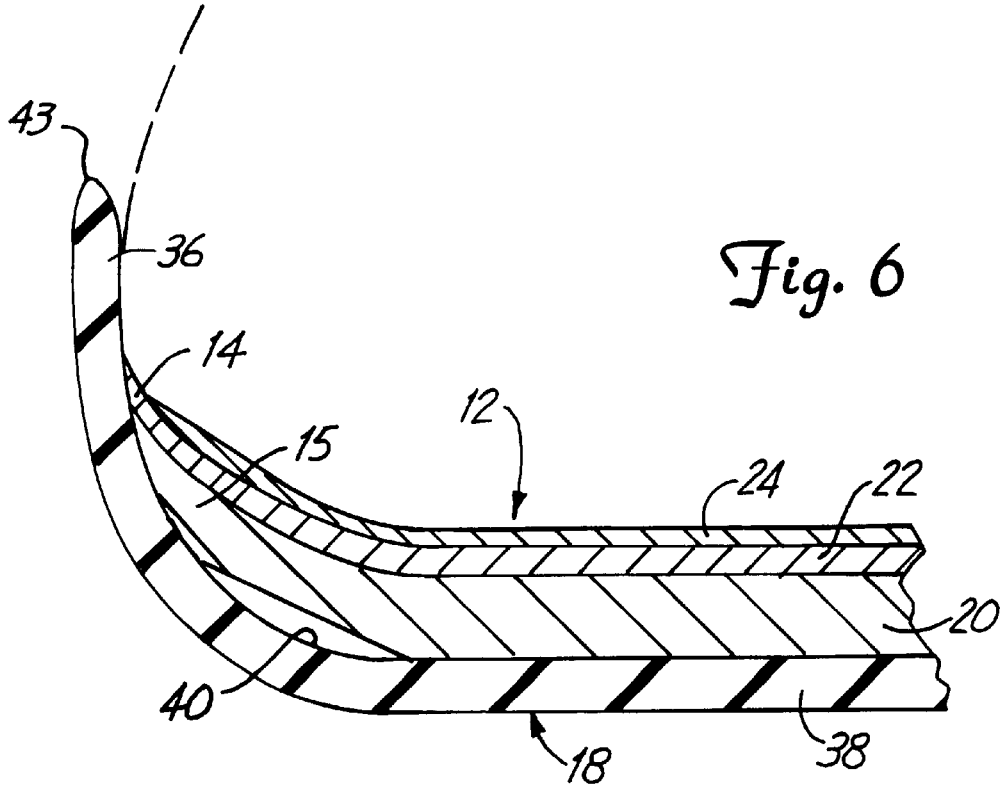
FIG. 6 is an enlarged sectional view taken as on line 6—6 in FIG. 1.

The cupping wall 36 effectively contains the soft tissue and cradles the foot. The top edge 43 of wall 36 lies almost along a horizontal plane and is slightly higher than the apex of the lateral foot contour, shown by dotted lines in FIGS. 5 and 6. The apex is along the line where a vertical plane is tangent to the lateral foot contour. If the edge 43 is below this line it will dig into the tissue and the tissue will roll over the edge. The lateral foot contour is the bulge or soft tissue on the lateral side of the heel and midfoot. As shown in FIGS. 5 and 6, the lateral side or cup wall 36 is higher than the insole and it the curved wall portion 14 is provided, it terminates below the top edge of wall 36.

The surface of wall portion 40 between the upper surface of the plantar wall 38 and the inner surface of perpendicular or cup wall 36 is contoured to match the anatomical structure and surface contours of the soft tissue of the foot, as the wall portion 40 moves from the proximal end of the shell to the distal end 50. The wall portion 40 includes a cupping contour (concave) surface 40A posterior and lateral to the heel (see FIGS. 3 and 4), and a supporting contour (convex) surface region 52 to maximize contact with the foot in the lateral arch region. The plantar wall 38 may include a relief contour 53 (interiorly concave) at the base of the fifth metatarsal. Further, a supporting contour (interiorly convex/neutral) surface 55 can be provided to maximum contact with the foot before the transition to the flat plantar surface, to push in to contact the foot area along the shaft of the fifth metatarsal.

The radiused wall portion surface 40 can be made to have a greater radius in the heel area to again conform more closely to soft tissue around the calcaneus of the foot on the lateral and heel side. Generally, the radius is maintained at about ⅜ to ⅝ inches (inside surface) along the wall portion 40.

The shell plantar wall 38 extends to the medial side of the shell and is substantially the full width of the insole in the calcaneus region, but the medial trim line tapers inwardly as shown at 46 to allow the shell to sit flat in the shoe while maintaining optimal medio-lateral contact to avoid wandering in the region adjacent the longitudinal arch. The shell then tapers out as shown at 48 in dotted lines in FIG. 1 to follow the profile of the plantar surface of the footbed of the shoe and provide support along the medial side of the foot.

A distal edge 50 of the shell, also shown in dotted lines, terminates to the rear of the metatarsal heads or metatarsal-phalangeal (MP) joints shown generally at 51 to permit dorsi-flexing of the toes and MP joints of the foot during running, as can be seen. It terminates short (to the rear of) of the edge 30 of the low friction material region 24C.

The arch portion 57 of the base or plantar wall 38 is relatively flat as illustrated in FIG. 3 to provide minimal support in the arch area. This permits custom fitting of the insole pad in the arch region.

Figure 9:
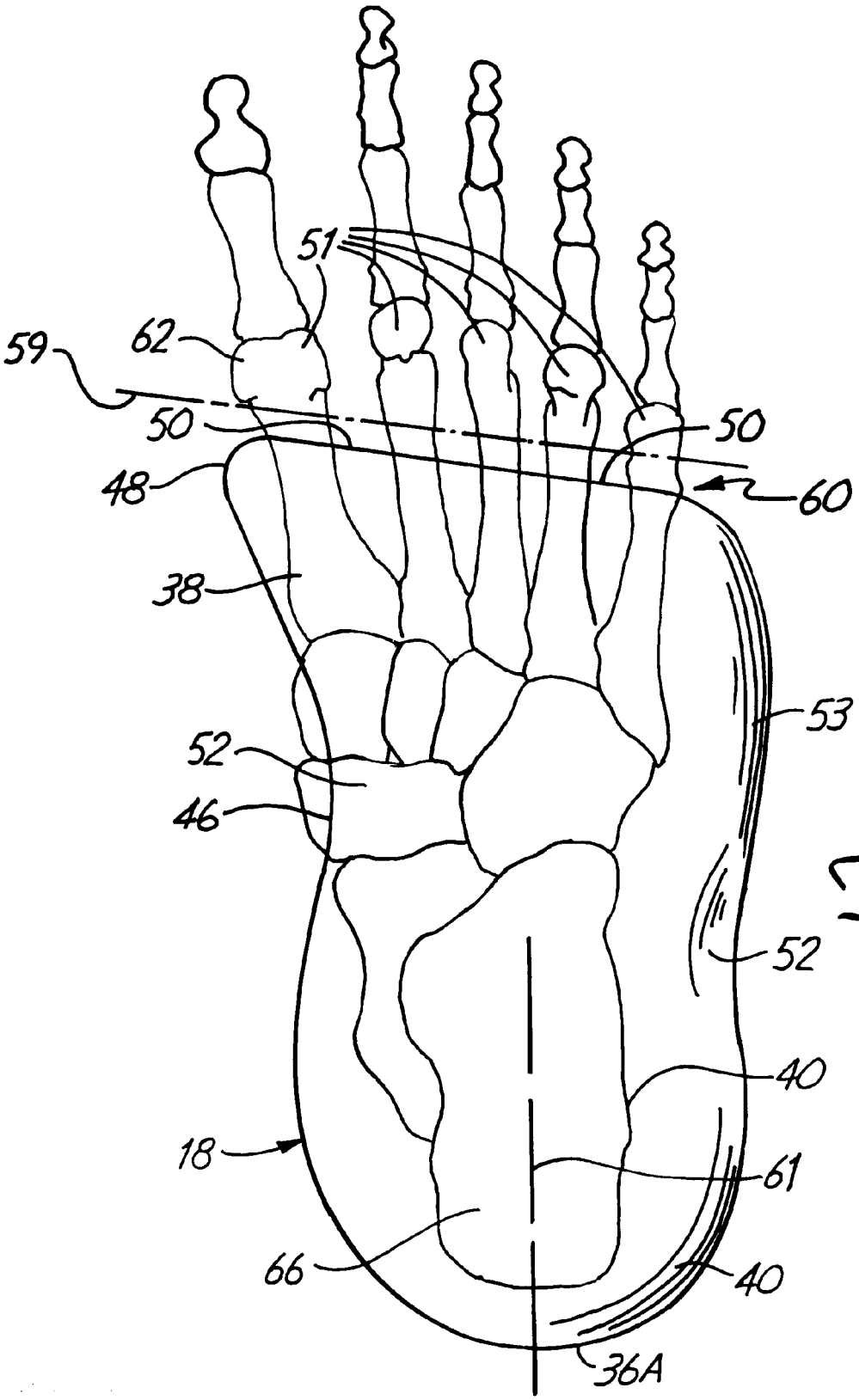
FIG. 9 is a bottom plan schematic view showing the bone structure of a foot in place with an overlay of the shell member for illustrating positioning.

FIG. 9 illustrates the metatarsals shown generally at 60 of the foot from a plantar (bottom) view of the left foot. The shell 18 is shown, and the postero-lateral wall transition region where the rounded wall portion 40 of the cup wall 36 join the plantar wall 38 is indicated at 36A. The distal edge 50, as can be seen, is positioned along a straight line parallel and just to the rear of a line drawn tangent to the head of the first metatarsal shown at 62, and to the head of the fifth metatarsal shown at 64. This location is so that the MP joints can flex easily. The calcaneus 66 and surrounding soft tissue is fully supported on the shell plantar surface wall 38. The transition surface 40 and the cup wall 36 extend around the rear of the heel to about the midline 61 of the foot in the calcaneus region 66 and extends forwardly along the lateral side of the foot to the distal trim line 50. The rounded transition 40 surface covers the initial contact area for a runner, and as the shell is impacted in this initial contact area, it moves as a unit to distribute the impact force to every surface of the foot it is in contact with, including the plantar wall 38, the transition surface 40 and the upright wall 36.

The shell 18 is formed to follow and support the anatomy of the foot as it wraps up from the plantar surface behind and around the lateral side of the heel and the lateral side of the foot, with the objective of spreading initial contact forces over maximum area.

The low friction portion 24A of the insole surface in the heel region reduces shear trauma along the heel region and along the low friction lateral side web 24B. When the foot makes full contact with the ground, the low friction portion 24C substantially reduces or prevents shear between the foot and the insole, which results in lower risk of blistering and calluses. Yet, the higher friction area 34 under the toes, such as a fabric liner on the foam layer provides for good reaction of loading as the foot pushes off.

Figures 11, 12:
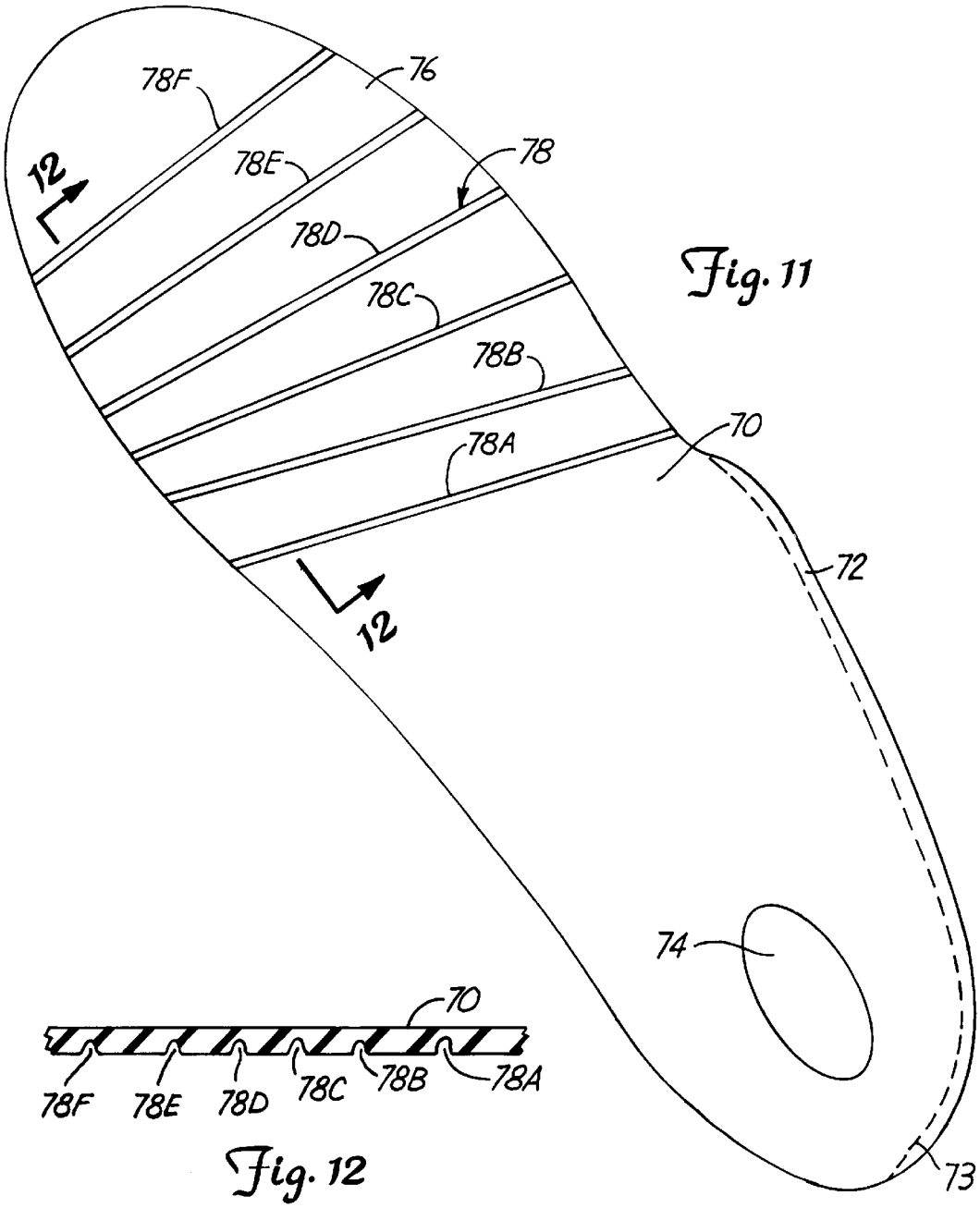
FIG. 11 is a bottom plan view of a full length shell used in an insole having hinges formed to permit the metatarsal phalangeal joints to flex.
FIG. 12 is a fragmentary sectional view taken on line 12—12 in FIG. 11.

A modified form of the shell is shown in FIGS. 11 and 12. FIG. 11 is a bottom view, which shows the bottom side of a base or plantar wall 70, made of suitable rigid or semi-rigid plastic material as in the first form of the invention, and including a lateral upright wall 72 that curves around the rear of the heel section shown at 73.

A recess 74 is provided in the calcaneus region of the foot, and the other features of forming in the insole area described in the first form of the invention can also be utilized. In this form of the invention, the insole has a forwardly extending portion 76 that extends under the toes and across the metatarsal regions of the foot. It has essentially a full foot form, and in order to accommodate flexing of this rigid sole in the metatarsal area, a series of hinge forming grooves 78 are provided. The first such groove shown at 78A is to the rear of the metatarsal regions, and additional grooves such as grooves 78B, 78C, 78D, 78E and 78F are all formed at an orientation that permits the metatarsal joints to flex fully as the person wearing the shell strides, and completes a stride for push off. The showing in FIG. 11 is exemplary only. As seen in FIG. 12, these hinge areas comprise grooves that extend partially through the rigid material to provide a flexing action and permit ease of foot flexing. The spacing of the grooves 78A–78F can be selected as desired, and the orientation can also be selected to provide for comfort and ease of hinging, but yet providing protection for the foot in this region. The full length shell will prevent stones and the like from causing substantial damage to the feet.

Thus, the insole of the present invention provides for redistribution of impact force over larger soft tissue areas, as well as friction control at the high load areas of the foot during running. The friction is reduced immediately under the heel and in the ball of the foot region. A relatively high friction insole under the toes and under the instep for maintaining stability of the foot is provided.

The insole shown can be mounted in a regular running shoe, or can even be adapted for running with little additional sole structure, using a slipper front over the top of the foot to hold the sole in place. Straps could be mounted on the shell to hold the heel in position. The front edge or trim line of the shell base wall is behind the metatarsal heads, for ease of flexing of the foot during running, and the simple contour used will fit a reasonable range of different size feet. The distal trim line is adjusted to meet length sizing also the width can be adjusted. Extremely small or large sizes require adjusting the placement of the lateral arch and base of fifth metatarsal relief 55 on the shell. Thus, for the normal range of a human foot, instead of having individual sizes like shoes, three different sizes of the shells will cover the major range of shoe sizes and widths. The width also can be trimmed.

The foam insole does provide for cushioning, as stated. The slippery areas under the heel and under the metatarsal heads reduces the shear stresses that cause blisters and calluses. The ball of the foot of a runner sees substantial shear stress and extreme punishment in an ordinary running shoe.

It may be that a slippery area under the metatarsal heads and not under the heel (or vice versa) is the best solution to certain problems and/or running styles. This application does not claim they must be always used together for greatest benefit.

It is also recognized that friction management such as proposed in this application is expected to be very beneficial for people with diabetes who have, or are at risk for, the callousing and ulceration problems typical for that diagnosis.

Although the present invention has been described with reference to preferred embodiments, workers skilled in the art will recognize that changes may be made in form and detail without departing from the spirit and scope of the invention.

What is claimed is:

1. A shell support for a foot for reinforcement of an insole comprising a rigid shell member of a material maintaining its shape under impact loads of the foot, including a base wall having a heel portion that spans substantially a width of a heel supported on the insole, a lateral side portion having an upright lateral edge wall formed to the base wall and which tapers upwardly along the lateral side from proximal a metatarsal region rearwardly across a lateral arch area, and rearwardly to be posterior to the calcaneus region of the foot, and wrapping postero-lateral, an upright lateral edge wall having a height above an apex of a lateral foot contour in the lateral arch area and rearwardly, the base wall having a thickness along a medial side of the shell and which underlies the insole, said medial side of the shell extending forwardly to proximal of the first metatarsal head and then laterally to an anterior end of the lateral edge wall, and the upright lateral edge wall terminating posteriorly of the calcaneus region such that only the base wall extends along the medial side of the shell.

2. The shell of claim 1, wherein the lateral side of the base wall is curved upwardly under a lateral arch region of the foot of a wearer.

3. The shell of claim 1, in combination with an overlying insole covering comprising a foam layer conforming to the lateral edge wall of the shell along the lateral side of the foot, and a first low friction upper surface region under the metatarsal heads.

4. The shell of claim 3 and a second low friction upper surface region on the insole under the heel.

5. The shell of claim 4, wherein the insole covering has a higher friction surface that is exposed in a toe portion and in an arch region for stabilizing a foot on the insole relative to the insole and shell.

6. The shell of claim 2, wherein said base wall is a substantially planar member that is a substantially uniform thickness wall that forms a recess relief on a lateral side underlying the fifth metatarsal base and shaft area of the foot of a wearer.

7. The shell of claim 6, wherein said shell is made of a polypropylene material.

8. The shell of claim 6, wherein the lateral upright edge wall curves around a posterior side of the heel portion and terminates along a downwardly sloping edge that joins the base wall medial of a center line of the heel portion.

9. The shell of claim 1, wherein the base wall is a substantially planar member formed into concave recess in regions under a location where a plantar ligament attaches to the calcaneus of a foot of a wearer of the shell.

10. The shell of claim 1, wherein the forward edge of the base wall passes under the insole to the rear of metatarsal heads of a foot supported on the shell.

11. The shell of claim 1, wherein the forward edge extends forwardly of metatarsal heads of a foot supported on the shell, and a plurality of spaced hinge sections formed in the base wall of the shell including at least one hinge section rearwardly of metatarsal heads of a foot supported on the shell, and additional hinge sections positioned to permit bending of the base wall as the foot supported thereon moves in a stride.

12. A running insole construction for support for a foot comprising a foot print size layer of soft cushion material having an upper foot support surface with a low friction coefficient surface in at least one of a heel and a metatarsal region, at least a toe end of the upper surface being of higher friction material than the heel and metatarsal regions, and a rigid shell member of a material maintaining its shape under impact loads under the layer of cushion material, the shell having a heel portion that spans substantially the width of the cushion material, a lateral side portion that curves upwardly from the heel portion in a radius to form a cup wall along a lateral side of the cushion material layer, the cup wall extending from forwardly of a lateral arch region partially around the back of the heel of the cushion material layer, the shell having a base wall that underlies the cushion layer and supports the cup wall and which has a forward edge positioned to extend forwardly to just rearward of the metatarsal heads of a foot supported on the insole, the cup wall having an upper edge tapering down to the base wall at the heel portion of the shell, so that the upper edge terminates posteriorly of the calcaneus region such that only the base wall extends along a medial side of the shell.

13. The insole of claim 12, wherein the cup wall has a height along a lateral side to support laterally tissue on a lateral side of a foot supported on the insole.

14. The insole of claim 12, wherein the base wall is curved upwardly under a lateral arch region of the foot on the insole.

15. The insole of claim 12, wherein the cushion layer surface has a friction coefficient in a medial arch region higher than the low coefficient of friction region.

16. A running insole construction for support for a foot in a shoe comprising a foot print size layer of soft cushion material having a low friction coefficient upper foot support surface in at least heel and metatarsal regions, at least a toe end of the upper surface being of higher friction material than the material in the heel and metatarsal regions, whereby a foot slides on the heel and metatarsal regions on initial impact, and the higher friction material being positioned to resist sliding as a foot pushes off in a running stride, wherein said insole has a rigid base plantar wall under the soft cushion metatarsal and a heel cup portion along a lateral side of the foot curved around to a posterior side, and tapering down to the foot support at the posterior of the heel such that a medial side of the foot is free of the upright wall and supported on the base plantar wall.

17. The running insole construction of claim 16, wherein the low friction material comprises polytetrafluoroethylene.

* * * * *